United States Patent [19]

Miller et al.

[11] Patent Number: 5,073,137

[45] Date of Patent: Dec. 17, 1991

[54] TOY FOAM PLASTIC GLIDER WITH FLEXIBLE APPENDAGES

[76] Inventors: Jack V. Miller; Ruth E. Miller, both of 700 N. Auburn Ave., Sierra Madre, Calif. 91024

[21] Appl. No.: 551,280

[22] Filed: Jul. 12, 1990

[51] Int. Cl.[5] ..... A63H 27/00; A63H 3/04

[52] U.S. Cl. ..... 446/61; 446/390

[58] Field of Search ..... 446/61, 34, 376, 390, 446/99, 268; D21/83, 87, 165

[56] References Cited

U.S. PATENT DOCUMENTS

| | | | |
|---|---|---|---|
| D. 105,110 | 6/1937 | Kalep | D21/83 |
| D. 282,452 | 2/1986 | Insetta | D21/165 X |
| 858,090 | 6/1907 | Meinecke | 446/99 |
| 3,787,998 | 1/1974 | Kilroy, Jr. et al. | 446/61 |
| 4,109,411 | 8/1978 | Wetherell et al. | 446/61 |

*Primary Examiner*—Mickey Yu

[57] ABSTRACT

A toy glider in the form of a molded foam plastic animal figure has an animal body form fuselage including a longitudinal axis, generally parallel sides, a front end and a rear end. A pair of wings in the form of animal wings are attached to the fuselage in a horizontal plane parallel to the longitudinal axis of the fuselage. A nose section in the form of an animal head and attached to the front end of the fuselage and a tail section is attached to the rear end of the fuselage. One or more male appendage studs extend distance from a surface of the glider and engage elongated hollow, appendages in the form of animal limbs, each having an elastomeric and hollow recess at an angle to the length of the limb and frictionally engaged onto a respective appendage stud, whereby rotation of the limb changes the angle of the limb with respect to the fuselage. Each limb appendage has a compressive columm buckling strength high enough to support the static weight of the glider in a standing posture, and a bending buckling strength low enough to permit the limb to resiliently collapse under a dynamic bending load.

5 Claims, 4 Drawing Sheets

TOY FOAM PLASTIC GLIDER WITH FLEXIBLE APPENDAGES

BACKGROUND OF THE INVENTION

This invention relates to the field of toy gliders, and more specifically to reconfigurable toy gliders that may be transformed into a variety of flyable and non-flyable configurations, such as shown in my co-pending application Ser. No. 331,774 entitled RECONFIGURABLE ANIMAL FIGURE TOY GLIDER, and Ser. No. 512,769 entitled RECONFIGURABLE TOY GLIDER and my other co-pending patent applications entitled FOAM PLASTIC TOY GLIDER WITH DETACHABLE PYLON WINGS and TOY GLIDER WITH VARIABLE DIHEDRAL WINGS.

A primary purpose of the present invention is to provide a toy glider in the form of animal figure that is reconfigurable into various positions that are typical of animal activities and thereby providing greatly enhanced play value for a toy glider. Toy gliders as presently known are simply launched, glide a distance and then land. The play value lasts only a few seconds, and is generally restricted to outdoor use. The invention makes a glider a reconfigurable toy that may be used in play that extends a child's imagination.

Animal toys, representing animals that have relatively slender legs, tend to be fragile, and are therefore made thicker and heavy representations of the real animal, or else they often break in active play by a child. Therefore another purpose of the present invention is to provide a toy glider that has highly detailed parts that are durable in play.

Also, play values may be enhanced by permitting the child to reconfigure the animal toy to represent veried play activities, and therefore another purpose of the invention is to provide an animal toy in which limbs may be moved, or even manually interchanged to alter the form of the toy.

SUMMARY OF THE INVENTION

The foregoing purposes of the invention are achieved by the present invention by providing a molded foam plastic toy glider in the form of an animal figure having an elongated fuselage having a longitudinal axis, a front end and a rear end, a pair of wings in the form of animal wings, attached to the fuselage and having portions comprising a generally planar airfoil cross-sectional shape with a mean aerodynamic chord of the airfoils being parallel to the longitudinal axis of the fuselage when the glider is in a normal horizontal flight attitude. A nose section generally in the form of an animal head is attached to the front end of the fuselage and a tail section is attached to the rear end of the fuselage. Male appendage studs extend a distance from a surface of the glider and engage elongated, at least partially hollow, appendages in the form of animal limbs, each being at least partially elastomeric and having a hollow recess configured to match the size and shape of a respective appendage stud, and extending from the surface of the glider a greater distance than the length of the stud. The appendages are provided with elastomeric sockets which are frictionally engaged onto the respective appendage studs. The sockets may be at an angle to the length of the limb appendage, whereby rotation of the socket on the stud changes the angle of the appendage with repect to the glider surface. Each appendage in the form of an animal limb has a compressive column buckling strength high enough to support the weight load of the glider in a stationary standing posture, and a bending buckling strength low enough to permit the appendage to resiliently collapse under a transverse bending load less than the load required to fail the respective appendage stud supporting the appendage. The limb appendages may be moved from one stud to another, and may be positioned on any surface of the glider.

DETAILED DESCRIPTION OF THE DRAWINGS

Figure 1:
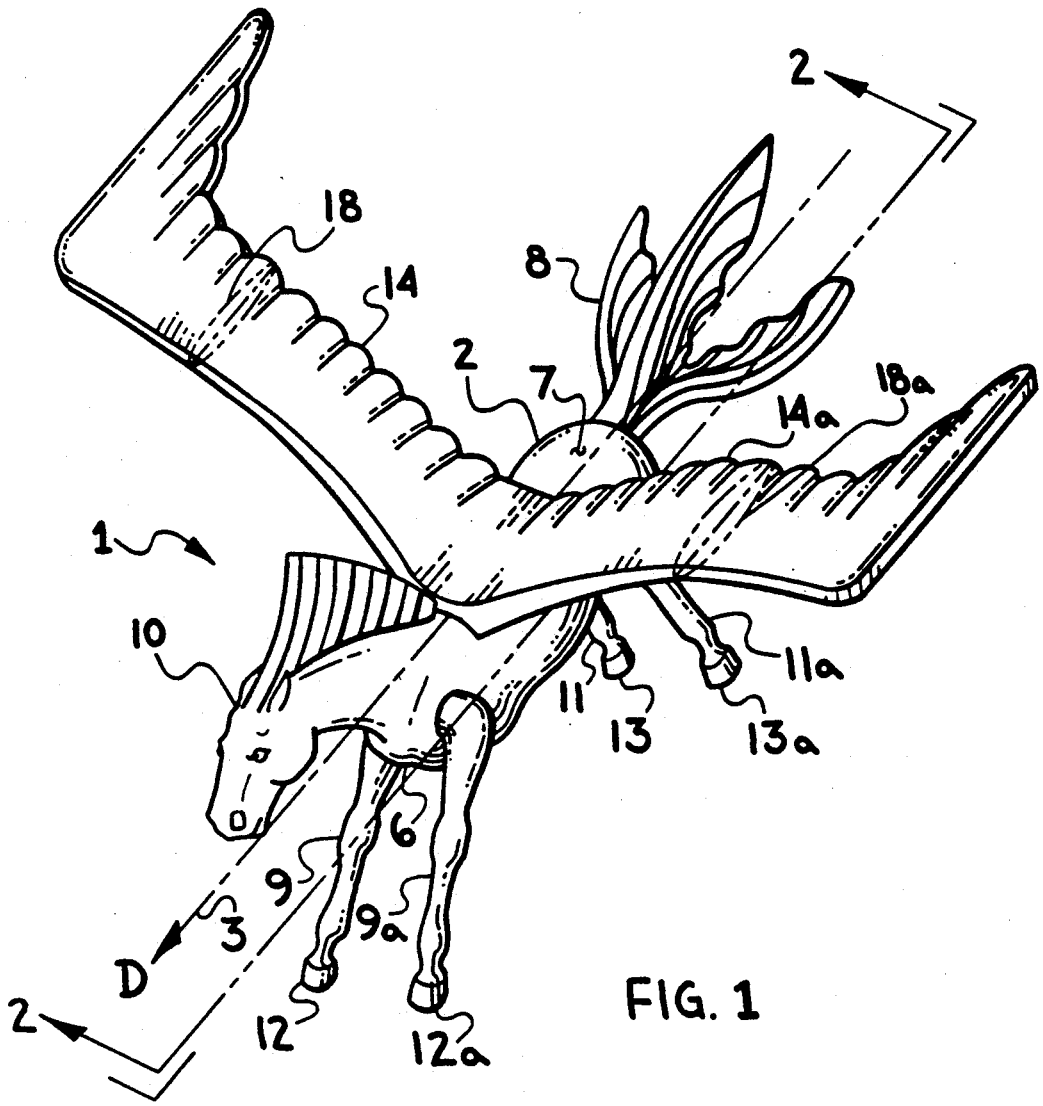
FIG. 1 is a perspective view of a toy glider acording to a preferred embodiment of the invention in the form of an animal figure in a flying configuration.

In FIG. 1 a molded plastic foam toy glider 1 in the form of an animal figure according to the invention is shown in the form of a flying horse, or Pegasus in normal level flying configuration, in which a fuselage 2, shown in the form of a horse torso, is elongated along a flight axis 3. The fuselage has a front end 6 including a simulated animal head 10, and a rear end 7 adapted for attachment of a tail empennage section 8. Front end 6 is adapted for the attachment of front legs 9 and 9*a*, respectively, and rear end 7 is adapted for the attachment of rear legs 11 and 11*a*. The simulated animal legs 9, 9*a*, 11 and 11*a* are provided with simulated animal feet 12, 12*a*, 13 and 13*a*, respectively, in a standing posture generally in the horizontal plane. Fuselage 2 is further provided with a pair of wings 14 and 14*a*, said wings being generally planar and disposed generally in a horizontal plane above the fuselage and being provided with areas with cross-sectional airfoil shapes having their areodynamic chords 18 and 18*a*, respectively, configured for flight in direction D.

Figure 2:
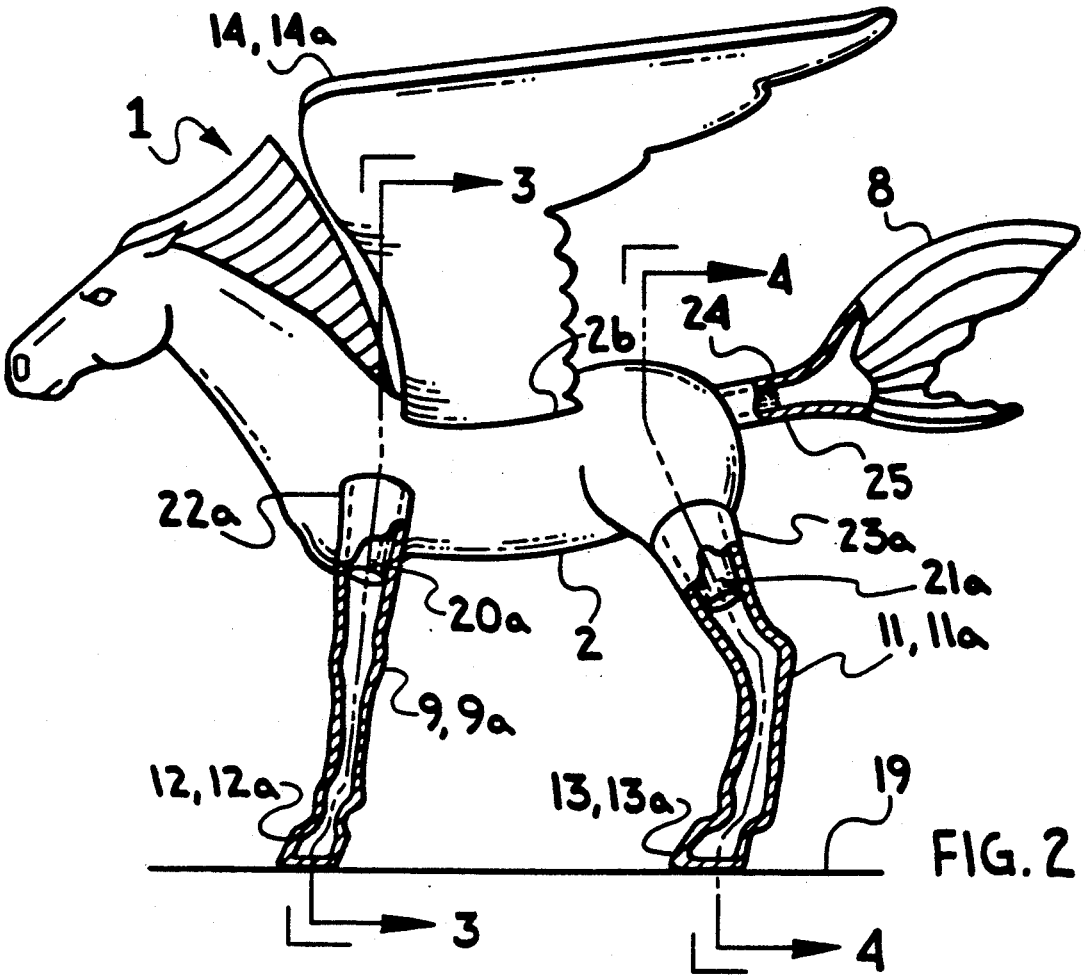
FIG. 2 is a partial cross section side elevation view of the glider of FIG. 1, taken along section line 2—2 of FIG. 1.

In FIG. 2 the toy glider 1 of FIG. 1 is shown standing in a quadruped position on a generally horizontal surface 19 supported by legs 9, 9*a*, 11, and 11*a* on feet portions 12, 12*a*, 13 and 13*a*, respectively. The legs are shown in a partial cross-sectional view in which studs 20*a* and 21*a* are shown being integral with fuselage 2 and generally in the depending direction. Legs 9*a* and 11*a*, respectively, are made at least in part, of an elastomeric material and are frictionally engaged onto the studs with leg socket portions 22*a* and 23*a*, respectively. The legs have sufficient buckling strength in compression to support the weight of the glider without collapsing when in a standing posture on horizontal surface 19.

Tail empennage section 8 is attached to rear end 7 of fuselage 2 by another stud 24, frictionally engaged into a tail empennage socket 25. Wings 14 and 14*a* are provided with a wing root section 26 attached to fuselage 2.

Figure 3:
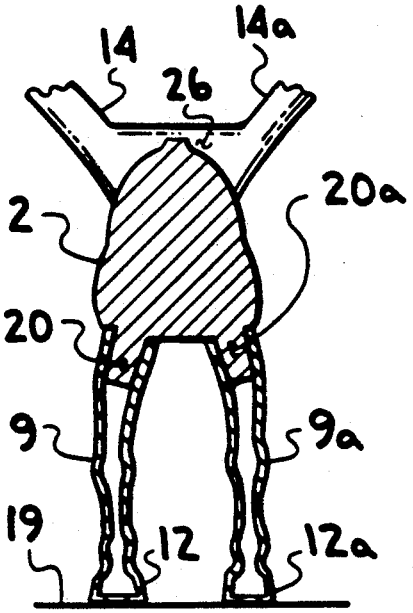
FIG. 3 is a cross-sectional view of the glider taken along section line 3—3 of FIG. 2.

In FIG. 3 the toy glider 1 of FIG. 2 is shown in cross section with front legs 9 and 9*a* engaged onto front studs 20 and 20*a*, respectively, in a standing position with front feet 12 and 12*a* standing on horizontal surface 19.

Figure 4:
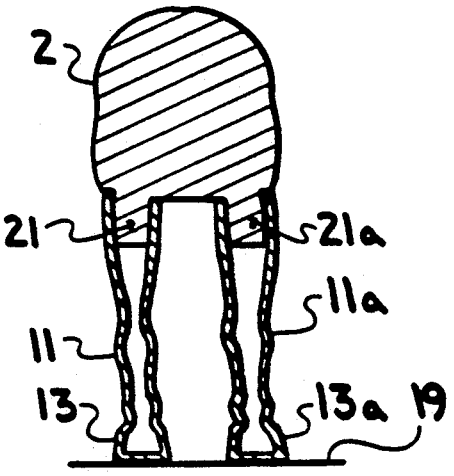
FIG. 4 is a cross-sectional view of the glider taken along section line 4—4 of FIG. 2.

In FIG. 4 the toy glider 1 of FIG. 2 is shown in cross section with rear legs 11 and 11*a* engaged onto front studs 21 and 21*a*, respectively, in a standing position with front feet 13 and 13*a* standing on horizontal surface 19.

Figure 5:
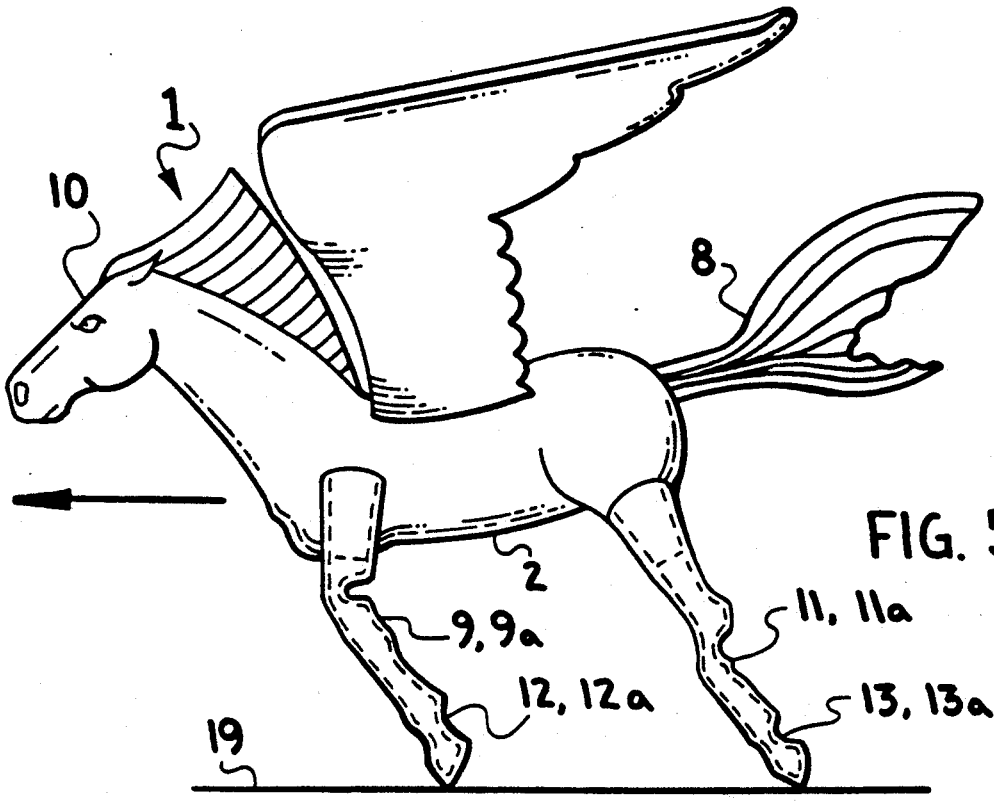
FIG. 5 is a side elevation view of the glider of FIG. 2, shown with a side bending load applied to the legs.

In FIG. 5 the toy glider 1 of FIG. 2 is shown in a quadruped position and moving forward along the generally horizontal surface 19 dragging legs 9, 9*a*, 11, and 11*a* on feet portions 12, 12*a*, 13 and 13*a*, respectively. The legs are shown in a bucked condition in which the bending moment applied in play or landing of the glider, causes the legs 9, 9*a*, 11 and 11*a* to fold back the hollow elastomeric material and thereby avoid permanent damage to the glider.

Figure 6:
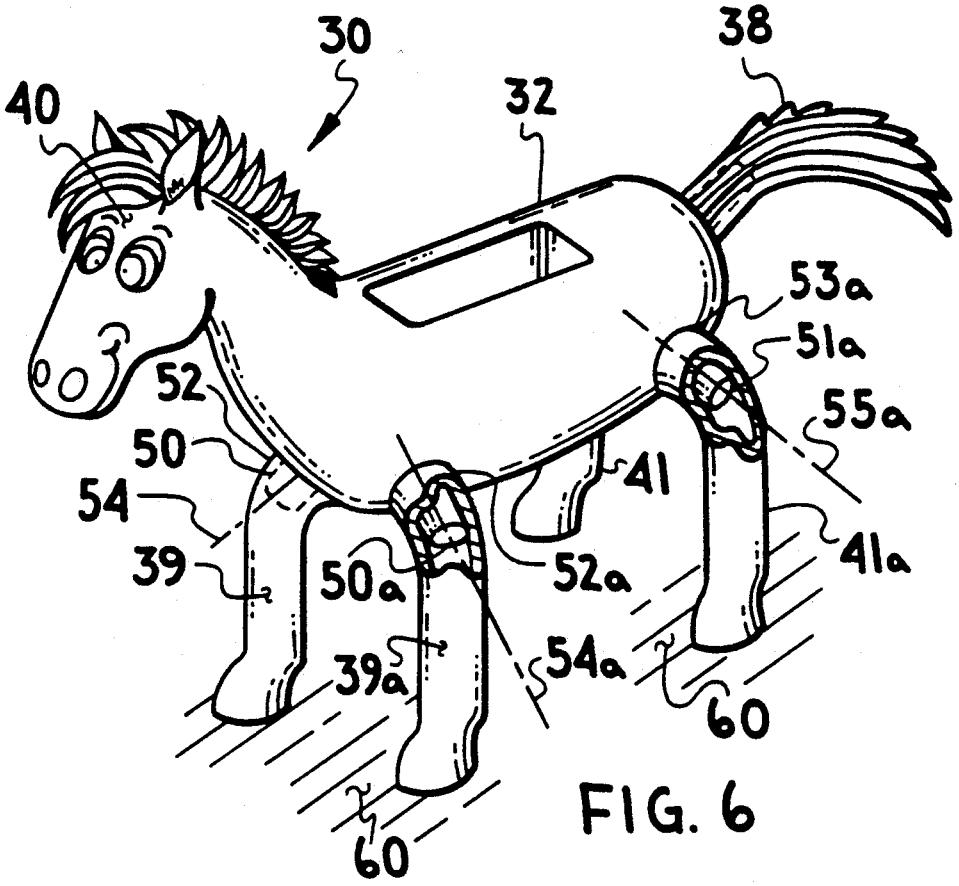
FIG. 6 is a perspecive view of a second preferred embodiment of the invention in a standing position, with the wings removed for clarity.

In FIG. 6 a second embodiment of the invention is shown in which the glider 30 has the wings removed for clarity. Glider 30 has a fuselage 32 having a head section 40 and a tail empennage section 38, and is provided with front leg stud 50, on angular axis 54 and front leg stud 50*a* on angular axis 54*a*, and rear leg stud 51 (not visible) on angular axis 55 (not visible) and rear leg stud 51*a* on angular axis 51*a*. Front leg 39 is provided with a canted socket 52 frictionally engaged onto stud 50, and front leg 39*a* is provided with a canted socket 52*a* frictionally engaged onto stud 50*a*, whereby front legs 39 and 39*a* are approximately vertical. Rear leg 41 is provided with a canted socket 53 (not visible) frictionally engaged onto stud 51 (not visible), and rear leg 41*a* is provided with a canted socket 53*a* frictionally engaged onto stud 51*a*, whereby rear legs 41 and 41*a* are approximately vertical when standing on surface 60.

Figure 7:
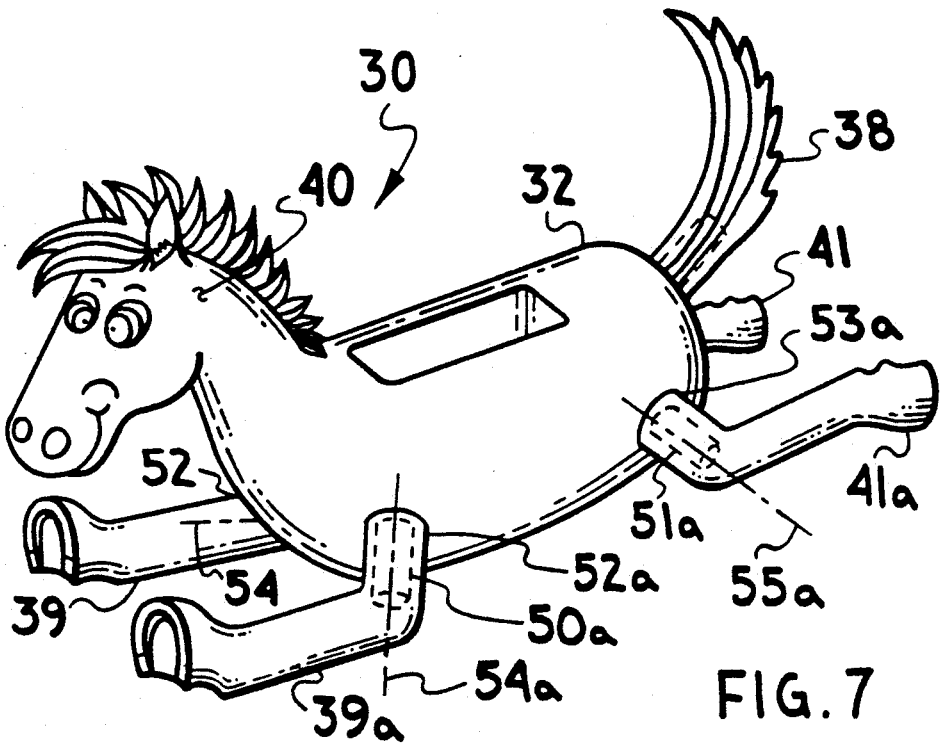
FIG. 7 is a perspecive view of the second preferred embodiment of the invention of FIG. 6, showing the legs moved to a horizontal position.

In FIG. 7 the second embodiment of the invention is also shown in which the glider 30 has the wings removed for clarity. Front leg 39 is rotated on canted socket 52 frictionally engaged onto stud 50 (not visible), and front leg 39*a* is rotated on canted socket 52*a* frictionally engaged onto stud 50*a*, whereby front legs 39 and 39*a* are approximately horizontal in the forward direction. Rear leg 41 is rotated on canted socket 43 (not visible) frictionally engaged onto stud 51 (not visible), and rear leg 41*a* is rotated on canted socket 53*a* frictionally engaged onto stud 51*a*, whereby rear legs 41 and 41*a* are approximately horizonal in the rearward direction. Is is obvious that either or both of the front or rear legs may be rotated to any angle in either direction, and may be rotated fully in the opposite direction, whereby the front legs may be placed in the rearward direction and the rear legs may be placed in the forward direction. Further, the legs and tails empennage shown have identical sockets frictionally engaged onto identical studs, whereby the appendages may be rearranged, or removed and replaced with appendages of different appearances.

The primary purposes of the invention, to provide a toy glider in the form of a reconfigurable animal figure with resilient and durable limb appendages that may replicate in detail animal anattomy, is achieved by the invention as shown and described herein. The invention illustrates a set of proportions selected to most clearly demonstrate the functions of the toy. It is obvious that many variations may be used to produce substantially the same result. The aesthetic design of the animal form shown in the drawings is not to be construed as limiting the scope of the invention to the horse or pony figures illustrated, but many other forms may be adapted to the structure of the invention within the scope of the claims.

The appendage studs are shown as cylindrical, but may as well be oval or polygonal within the scope of the invention.

We claim:

1. A molded plastic foam toy glider in the form of an animal figure comprising:

an elongated fuselage generally symmetrical about a vertical plane, having a longitudinal axis, generally parallel sides, a front end and a rear end, when said toy glider is in a normal horizontal flight orientation, the fuselage being generally in the form of an animal torso;

a pair of wings in the form of animal wings, attached to the fuselage and having portions comprising a generally planar airfoil cross-sectional shape with a mean aerodynamic chord of the airfoils being approximately parallel to the longitudinal axis of the fuselage;

a nose section generally in the form of an animal head and attached to the front end of the fuselage;

a tail section empennage at the rear end of the fuselage;

one or more generally cylindrical male appendage studs extending a distance from a surface of the glider, and canted at an angle with respect to the vertical plane of the fuselage;

one or more elongated, at least partially hollow, appendages in the general form of animal limbs, each having an elastomeric and hollow recess configured to match the size and shape of a respective appendage stud, each said appendage having a substantial portion thereof at an obtuse angle with respect to the respective recess and extending from the surface of the glider a greater distance than the length of said respective appendage stud, whereby rotation of an appendage about its respective stud causes a change in the angle of the appendage with respect to the vertical plane of the fuselage.

2. A toy glider according to claim 1 in which the appendages are frictionally engaged onto the respective appendage studs.

3. A toy glider according to claim 1 in which each elongate appendage in the form of an animal limb has a compressive column buckling strength high enough to support the weight load of the glider in a stationary standing posture, and a bending buckling strength low enough to permit said appendage to resiliently collapse under a transverse bending load less than the load required to fail the respective appendage stud supporting the appendage.

4. A toy glider according to claim 1 in which at least one appendage stud is in the form of a generally cylindrical cantilever beam having a length no greater than three times its diameter.

5. A toy glider according to claim 1 in which appendages may be removed from their appendage studs and engaged onto different studs, whereby the configuration of the glider may be altered.

* * * * *